US007508293B2

(12) United States Patent
Groezinger et al.

(10) Patent No.: US 7,508,293 B2
(45) Date of Patent: Mar. 24, 2009

(54) MAGNETIC CIRCUIT FOR IGNITION COILS OR TRANSFORMERS

(75) Inventors: Stefan Groezinger, Blaichach (DE); Guenter Escher, Oberstdorf (DE); Lothar Detels, Burgberg (DE); Konstantin Lindenthal, Blaichach (DE); Thomas Breckle, Bihlerdorf (DE); Nikolaus Hautmann, Weitnau (DE); Tim Skowronek, Missen-Wilhams (DE); Werner Steinberger, Rauhenzell (DE)

(73) Assignee: Robert Bosch GmbH, Stuttgart (DE)

( * ) Notice: Subject to any disclaimer, the term of this patent is extended or adjusted under 35 U.S.C. 154(b) by 187 days.

(21) Appl. No.: 11/544,155

(22) Filed: Oct. 6, 2006

(65) Prior Publication Data

US 2007/0096859 A1 May 3, 2007

(30) Foreign Application Priority Data

Oct. 11, 2005 (DE) ..... 10 2005 048 544

(51) Int. Cl.
*H01F 27/24* (2006.01)

(52) U.S. Cl. ..... 336/234

(58) Field of Classification Search ..... 336/65, 336/83, 192, 210–212, 214–215, 225, 229, 336/220–222, 233–234; 123/632–635
See application file for complete search history.

(56) References Cited

U.S. PATENT DOCUMENTS

| | | | | |
|---|---|---|---|---|
| 1,634,923 | A | 7/1927 | Thullen | |
| 1,992,822 | A | 2/1935 | Granfields | |
| 4,047,138 | A | 9/1977 | Steigerwald | |
| 4,229,721 | A | 10/1980 | Koloczek et al. | |
| 4,365,223 | A | 12/1982 | Fechant et al. | |
| 4,843,362 | A * | 6/1989 | Heritier-Best | 336/61 |
| 4,926,152 | A * | 5/1990 | Ito et al. | 336/90 |
| 5,128,646 | A * | 7/1992 | Suzuki et al. | 336/110 |
| 6,956,456 | B2 * | 10/2005 | Mihara et al. | 336/178 |
| 7,202,767 | B2 * | 4/2007 | Maekawa et al. | 336/110 |
| 7,212,092 | B2 * | 5/2007 | Nuebel et al. | 336/83 |

FOREIGN PATENT DOCUMENTS

| | | |
|---|---|---|
| EP | 1211699 | 6/2002 |
| FR | 238902 | 8/1960 |
| FR | 2098434 | 3/1972 |
| FR | 2290007 | 5/1976 |
| GB | 360952 | 11/1931 |
| GB | 646464 | 1/1948 |
| GB | 600842 | 4/1948 |
| GB | 2073955 | 10/1981 |
| JP | 2000182860 A * | 6/2000 |

* cited by examiner

*Primary Examiner*—Tuyen T. Nguyen
(74) *Attorney, Agent, or Firm*—Kenyon & Kenyon LLP

(57) ABSTRACT

A magnetic circuit for an ignition coil or a transformer, including an inner, essentially rod-shaped core and an outer core. The outer core includes a strip-shaped element of thickness, length and width, and is situated around the inner core in such a way that the strip-shaped element is positioned at the faces of the inner core with its thickness perpendicular to the longitudinal direction of the inner core.

8 Claims, 3 Drawing Sheets

MAGNETIC CIRCUIT FOR IGNITION COILS OR TRANSFORMERS

FIELD OF THE INVENTION

The present invention relates to a magnetic circuit for an ignition coil or a transformer, and to an ignition coil or a transformer having such a magnetic circuit.

BACKGROUND INFORMATION

Ignition coils are used for example in vehicles having a spark ignition engine to trigger a spark plug, in order to ignite a fuel mixture in a combustion chamber of the spark ignition engine. Ignition coils are constructed for example as rod ignition coils, in which a primary coil and a secondary coil are situated around a centrally located rod core of a magnetizable material. A storable magnetic energy for the ignition coil depends significantly on the design of its magnetic circuit. A known magnetic circuit is depicted in FIGS. 6*a* and 6*b*. As is apparent from FIG. 6*b*, this magnetic circuit has what is known as an O-I core arrangement. An inner core 10 and an outer core 11 of the magnetic circuit are each made up of a large number of plate-like leaves. The leaves of outer core 11 have an essentially O-shaped form, with a projection 11*a*. The leaves of outer core 11 are produced by stamping, it being necessary for reasons of production technology to maintain a certain minimum width Y. Width Y is significantly greater than thickness Z of the individual leaves (see sectional drawing 6*a*, which is cut along line A-A of FIG. 6*b*).

Because of the steadily shrinking designs of transformers and ignition coils, greater and greater demands are being made on the magnetic circuits of such components in terms of efficiency and size. Special attention must be paid to equality of cross sections and absence of air gap when magnets are used. If no magnets are employed, a defined air gap must be provided instead of the magnet. Furthermore, because of the need for overlap between the inner and the outer core, the space is inadequately utilized in the height direction (in the direction of thickness Z of the leaves stacked one above the other).

SUMMARY OF THE INVENTION

By comparison, the magnetic circuit of the present invention has the advantage that it occupies a smaller space while having improved efficiency. This is achieved according to the present invention by changing the orientation of the outer leaf-construction core by 90°. According to the present invention, the outer core includes a strip-shaped element (leaf) having a certain thickness (sheet thickness), and is situated around the inner core in such a way that the strip-shaped element is positioned at the faces of the inner core with its thickness perpendicular to the longitudinal direction of the inner core. The result according to the present invention is to permit improved overlap between the inner and the outer core, and reduction of space required in particular in the direction of the longitudinal axis of the inner core. This is possible according to the present invention because a thickness (sheet thickness) of a leaf is always smaller than a possible width Y for a leaf in the stamping process (see FIGS. 6*a* and 6*b*).

Preferably, a gap formed between a first end area and a second end area of the outer core is situated at a face of the inner core.

It is also preferred for a permanent magnet to be located between the inner core and the outer core. The permanent magnet is preferably positioned in the area of the gap in the outer core.

In order to enable simple, fast, and inexpensive assembly of the magnetic circuit, the inner core and the permanent magnet are fixed in an inner area of the outer core with the aid of a clamp connection. It should be noted that a connection between the inner and the outer core or permanent magnet is also possible using bonding or welding or some other thermal process.

In order to exhibit particularly high efficiency, the inner core is preferably of asymmetric design. It is particularly preferred that a ring-shaped projection directed outward in the radial direction be formed on an end area of the inner core. According to another preferred embodiment of the present invention, the ring-shaped projection is also formed asymmetrically with respect to a plane that contains the center line of the inner core.

For simplicity of manufacture the outer core is preferably made from one single sheet metal strip, or of two sheet metal strips. This makes it possible in particular to ensure that the total length of the magnetic circuit is small both in the axial direction and in the width direction of the inner core, so that the space of the magnetic circuit is as small as possible. A width of the outer core is chosen to enable optimal magnetic efficiency.

The present invention also relates to an ignition coil or a transformer that includes a magnetic circuit according to the present invention. The ignition coils according to the present invention are preferably used in vehicles. Because of the small space requirement and their low weight, they can be employed in vehicles particularly advantageously.

DETAILED DESCRIPTION

A magnetic circuit 1 according to a first exemplary embodiment of the present invention is described in the following with reference to FIGS. 1 through 3.

Figure 1:
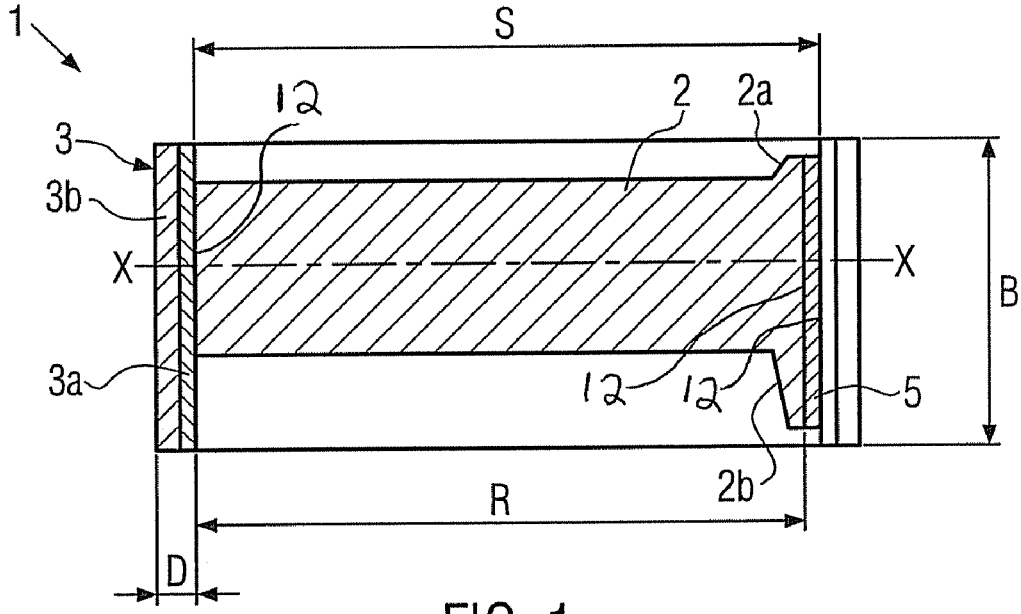
FIG. 1 shows a schematic sectional view of a magnetic circuit according to a first exemplary embodiment of the present invention.
Figure 2:
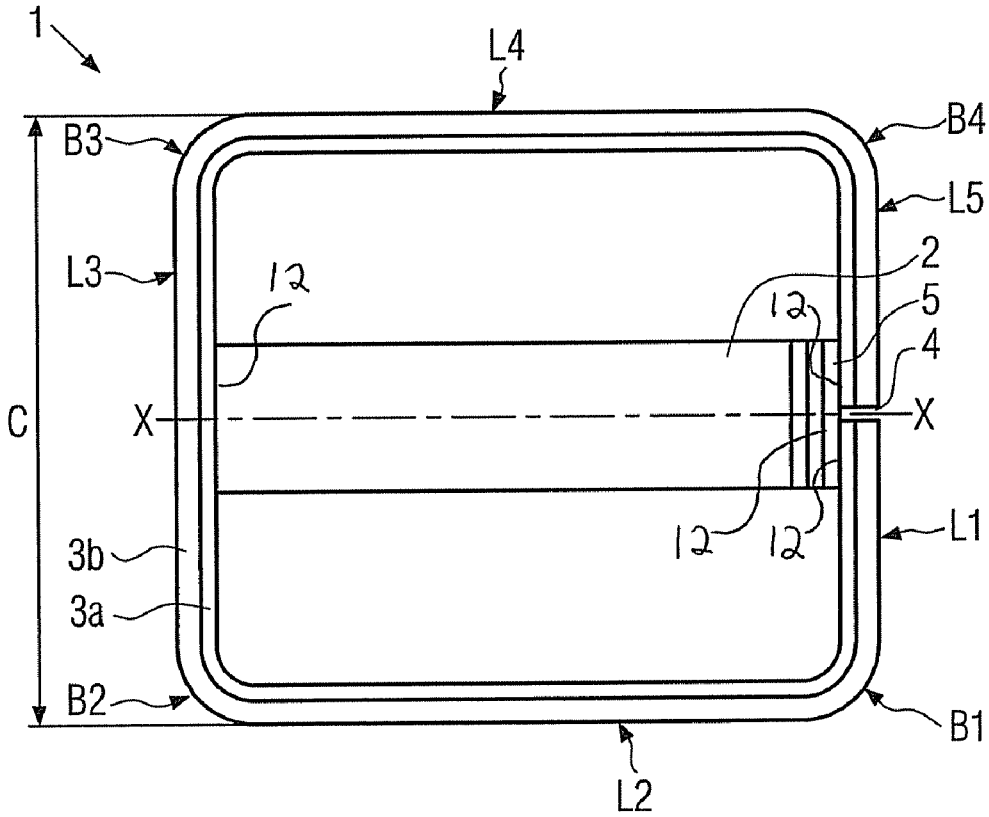
FIG. 2 shows a schematic top view of the magnetic circuit shown in FIG. 1.
Figure 3:
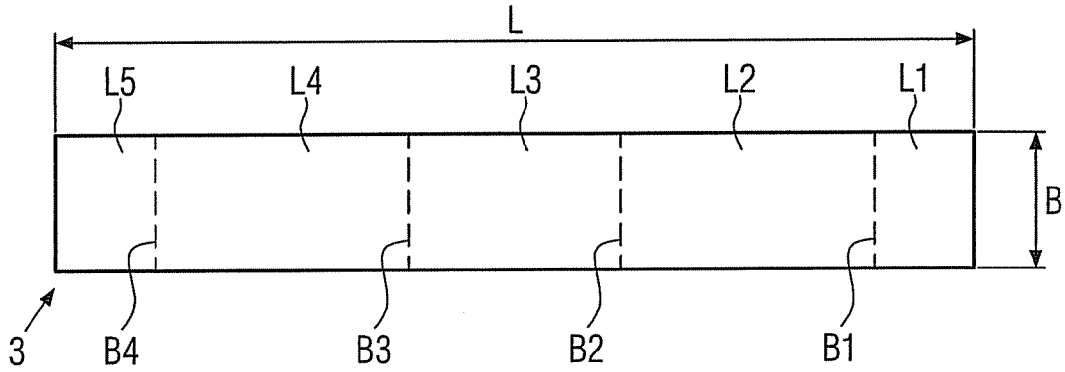
FIG. 3 shows a top view of a strip-shaped element which is shaped into the outer core in the first exemplary embodiment.

As shown in FIGS. 1 and 2, magnetic circuit 1 includes an inner core 2 and an outer core 3. Outer core 3 is made of a first strip-shaped element 3*a* and a second strip-shaped element 3*b*. Inner core 2 is a rod core, and is of essentially cylindrical design in the longitudinal direction X-X of rod core 2. As may be seen from FIG. 1, inner core 2 is of asymmetric design. Located on its one face lying in the longitudinal direction X-X is a ring area projecting radially outward, which is itself likewise asymmetric with respect to longitudinal direction X-X. More precisely, a small radial projection 2*a* is formed in one radial direction, and a larger radial projection 2*b* is formed in the opposite radial direction. Also located on the face of inner core 2 with the asymmetric projections 2*a*, 2*b* is a magnet element 5 between inner core 2 and outer core 3. Magnet element 5 has a shape that corresponds to the face of inner core 2 with projections 2*a*, 2*b*. The width dimension of the magnetic circuit is labeled C.

As mentioned, outer core 3 is made from a first and a second strip-shaped element 3*a* and 3*b*. FIG. 3 shows an initial form of a strip-shaped element prior to installation around inner core 2. Strip-shaped element 3 is stamped from a metal sheet, and has a total length L, a width B and a thickness corresponding to the thickness of the sheet metal. In FIG. 3, the bending lines around each of which outer core 3 is bent by 90° in order to assume the shape visible in FIGS. 1 and 2 are labeled B1, B2, B3 and B4. The individual flat segments of the outer core that result from the bending process are labeled L1, L2, L3, L4 and L5. A width of the strip-shaped element is labeled B.

Outer core 3 of the first exemplary embodiment is produced by laying a first radial element 3*a* and a second radial element 3*b* one on top of the other and bending the stacked sheets jointly by 90° at bending lines B1, B2, B3 and B4. That gives outer core 3 an essentially rectangular shape, while a gap 4 is preserved between the starting and ending areas of the outer core. An inner length of the outer core in the direction of longitudinal axis X-X of inner core 2 is labeled T in FIG. 2. A length of inner core 2 in the longitudinal direction X-X is labeled R in FIG. 1, and a length of the inner core with permanent magnet 5 in the longitudinal direction X-X is labeled S in FIG. 1. Inner core 2 with permanent magnet 5 is now attached in the inner area of outer core 2 with the aid of a clamp connection 12, inner length T of outer core 3 being somewhat shorter than length S of the inner core with permanent magnet 5, in order to achieve the clamping. That makes it possible to accomplish a simple assembly and a simple and inexpensive configuration of the magnetic circuit.

A thickness of the outer core is labeled D in FIG. 1. The thickness of the outer core is made up of the particular sheet thicknesses of the strip-shaped elements for outer core 3. Thickness D of outer core 3 of the first exemplary embodiment is thus twice the sheet thickness of a strip-shaped element. A width B of outer core 3 corresponds here to the width of the strip-shaped elements. As FIG. 1 shows, width B of outer core 3 is somewhat greater than a maximum length of inner core 2 on one of its faces in the radial direction. These dimensions are chosen in order to achieve an optimal possible magnetic efficiency.

As may be seen in particular from FIGS. 1 and 2, a reduced space is thereby obtained for magnetic circuit 1, in particular in longitudinal direction X-X. That also makes it possible to reduce the space requirement for an ignition coil that includes this magnetic circuit. The clamp connection 12 between inner core 2, permanent magnet 5 and outer core 3 also makes it possible to achieve a magnetic circuit having no air gap. It should be noted that in an embodiment without a magnet the defined air gaps are achieved over the inner length of the outer core, as well as the length of the inner core. Let it be noted further that it is also possible to use a symmetrically shaped inner core.

Figure 4:
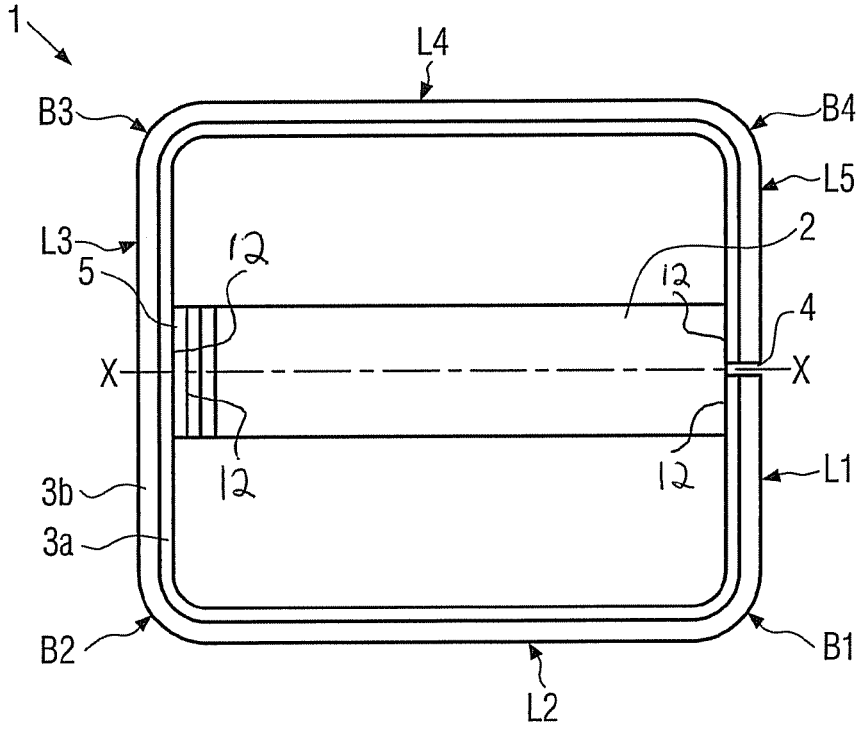
FIG. 4 shows a top view of a magnetic circuit according to a second exemplary embodiment of the present invention.

FIG. 4 shows a magnetic circuit 1 according to a second exemplary embodiment of the present invention, where identical or functionally identical parts are identified with the same reference numerals as in the first exemplary embodiment.

In contrast to the first exemplary embodiment, in the second exemplary embodiment a permanent magnet 5 is not located at the position of gap 4 of outer core 3, but on inner core 2 exactly opposite gap 4. Otherwise this exemplary embodiment corresponds to the first exemplary embodiment, so that reference may be made to the description given there.

Figure 5:
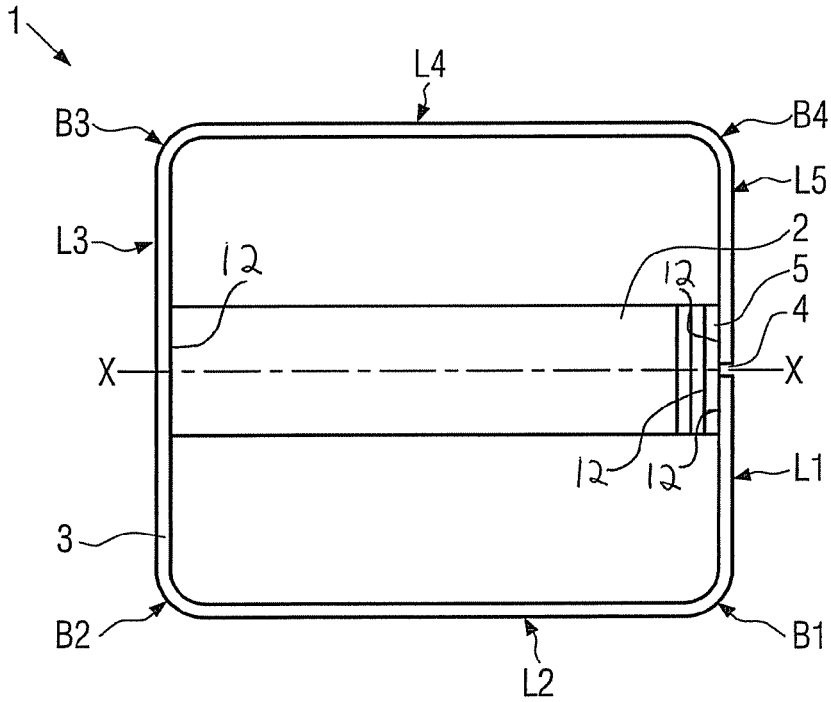
FIG. 5 shows a top view of a magnetic circuit according to a third exemplary embodiment of the present invention.
Figure 6A:
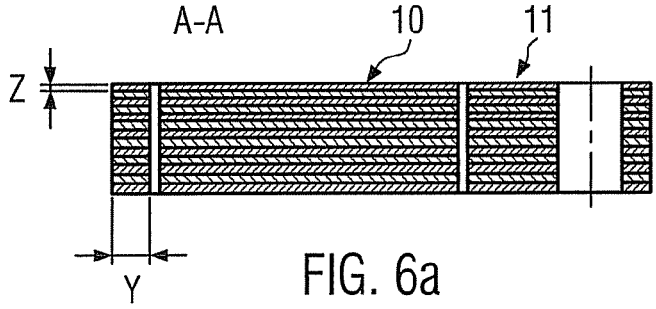
FIGS. 6*a* and 6*b* show views of a magnetic circuit according to the related art.
Figure 6B:
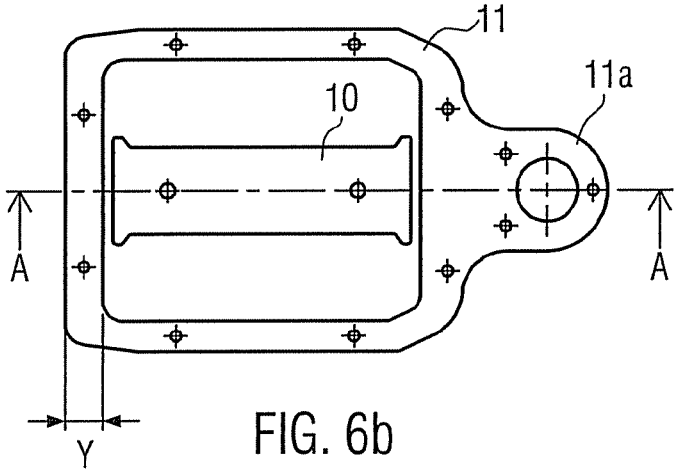

FIG. 5 shows a magnetic circuit 1 according to a third exemplary embodiment of the present invention, with the same reference numerals being used for identical or functionally identical parts as in the first exemplary embodiment.

In contrast to the preceding exemplary embodiments, outer core 3 of the third exemplary embodiment is made of only one strip-shaped element. That enables the dimensions and weight of magnetic circuit 1 of the third exemplary embodiment to be reduced. Otherwise the magnetic circuit of the third exemplary embodiment has the same configuration as the magnetic circuit of the first exemplary embodiment, so that the description given there can be referred to.

What is claimed is:

1. A magnetic circuit for one of an ignition coil and a transformer, comprising:

an inner, substantially rod-shaped core; and an outer core including a strip-shaped element having a thickness, a length and a width, the outer core being situated around the inner core in such a way that the strip-shaped element is situated at faces of the inner core with the thickness perpendicular to a longitudinal direction of the inner core;

wherein a gap formed between a first end area and a second end area of the outer core is situated at a face of the inner core;

wherein the face of the inner core at which the gap is situated has a width, which is parallel to, and substantially greater than, a width of the gap; and wherein the inner core is asymmetrical.

2. The magnetic circuit according to claim 1, further comprising a permanent magnet situated between the inner core and the outer core.

3. The magnetic circuit according to claim 2, wherein the permanent magnet is situated in an area of the gap.

4. The magnetic circuit according to claim 2, wherein the inner core and the permanent magnet are fixed in an internal area of the outer core with the aid of a clamp connection.

5. The magnetic circuit according to claim 1, wherein the asymmetrical inner core has an enlarged cross section at one face.

6. The magnetic circuit according to claim 1, wherein the outer core is made of one of (a) exactly one strip-shaped element and (b) two strip-shaped elements.

7. The magnetic circuit according to claim 1, wherein the magnetic circuit is of an ignition coil.

8. The magnetic circuit according to claim 1, wherein the magnetic circuit is of a transformer.

* * * * *